US006482274B2

(12) United States Patent
Shimakura et al.

(10) Patent No.: US 6,482,274 B2
(45) **Date of Patent: *Nov. 19, 2002**

(54) NONCHROMATE METALLIC SURFACE TREATING AGENT FOR PCM USE, METHOD FOR PCM SURFACE TREATMENT, AND TREATED PCM STEEL PANEL

(75) Inventors: Toshiaki Shimakura, Franfurt am Main (DE); Motohiro Sasaki, Kawasaki (JP); Katsuyoshi Yamasoe, Sakura (JP); Christian Jung, Oberhaid (DE)

(73) Assignee: Nippon Paint Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/793,711

(22) Filed: Feb. 27, 2001

(65) Prior Publication Data

US 2001/0037748 A1 Nov. 8, 2001

(30) Foreign Application Priority Data

Feb. 29, 2000 (JP) ..... 2000-053010

(51) Int. Cl.[7] ..... C23C 22/05; C23C 22/53; C23C 22/68; C23C 22/80; C23C 22/83

(52) U.S. Cl. ..... 148/247; 106/14.41; 106/14.42; 106/14.44; 148/243; 427/328; 427/387; 427/409; 427/419.2; 428/472.1

(58) Field of Search ..... 106/14.21, 14.44, 106/14.41, 17.42; 148/243, 247; 427/328, 387, 409, 419.2; 428/472.1

(56) References Cited

U.S. PATENT DOCUMENTS

| | | | | | |
|---|---|---|---|---|---|
| 5,969,019 | A | * | 10/1999 | Kanai et al. | 427/372.2 |
| 6,180,177 | B1 | * | 1/2001 | Nagashima et al. | 427/388.4 |
| 6,241,830 | B1 | * | 6/2001 | Shimakura et al. | 106/14.12 |
| 6,309,477 | B1 | * | 10/2001 | Shimakura et al. | 106/14.12 |

FOREIGN PATENT DOCUMENTS

| | | |
|---|---|---|
| JP | 8 73775 | 3/1996 |
| JP | 10 60315 | 3/1998 |
| JP | 11 29724 | 2/1999 |

* cited by examiner

*Primary Examiner*—Anthony J. Green
(74) *Attorney, Agent, or Firm*—Sughrue Mion, PLLC

(57) ABSTRACT

A nonchromate metallic surface treating agent comprising (a) a silane coupling agent and/or a hydrolytic condensation product thereof, (b) water-dispersible silica, and (c) a zirconium compound and/or a titanium compound is disclosed. The present invention also discloses a method for treating a surface of a PCM steel panel, a method of producing a PCM steel panel, and a PCM steel panel as produced by the method.

10 Claims, No Drawings

NONCHROMATE METALLIC SURFACE TREATING AGENT FOR PCM USE, METHOD FOR PCM SURFACE TREATMENT, AND TREATED PCM STEEL PANEL

FIELD OF THE INVENTION

The present invention relates to a metallic surface treating agent for metallic substrates, particularly precoated (hereinafter referred to briefly as PCM) steel panels for use as metal-coated steel plates such as the zinc-coated steel panel, aluminum-coated steel panel, tin-coated steel panel, etc., a method for surface treatment of a PCM steel panel, a method of producing a PCM steel panel, and a PCM steel panel as produced by said method.

PRIOR ART

As the metallic surface treating agent, a chromium-containing surface treating agent such as a chromate system or a phosphate-chromate system has heretofore been used broadly and still in use today. However, in view of the recent trend toward more stringent regulatory control for environmental protection, it is likely that the use of such coating systems will be restricted for fear of the toxicity, particularly carcinogenicity, of chromium. Therefore, development of a rust-preventing agent not containing chromium and yet as effective as the chromating agent in imparting corrosion resistance has been awaited. As disclosed in Japanese Kokai Publication Hei-11-29724, the inventors of the present invention previously developed a nonchromate rust-preventing agent comprising a water-base resin and, as incorporated therein, a thiocarbonyl group-containing compound, a phosphate ion, and water-dispersible silica. Regrettably, however, this system was found to be deficient in storage stability and somewhat poor in corrosion resistance at thin coating thickness. Meanwhile, with regard to silane coupling agents, an acidic surface treating agent containing two dissimilar silane coupling agents is disclosed in Japanese Kokai Publication Hei-8-73775. However, this system is intended to improve finger-print resistance and overcoat adhesion and is quite deficient in corrosion resistance for use in applications where high corrosion resistance and good processability are required after such metallic surface treatment as in the present invention. Moreover, Japanese Kokai Hei-10-60315 discloses a steel structure surface treating agent, which contains a silane coupling agent having a certain functional group reactive with an aqueous emulsion, but the corrosion resistance required here is only that of a degree satisfying comparatively mild test requirements such as those of wet tests and as far as corrosion resistance is concerned, the system is a far cry from a rust-preventing agent system as provided by the present invention. With the above state of the art byway of background, there has been a standing demand for development of a rust-preventing agent expressing sufficient corrosion resistance and overcoat adhesion at thin coating thickness.

Meanwhile, in the field of PCM steel panels, too, the advent has been awaited of a PCM steel panel produced by using a nonchromate rust-preventing agent and yet expressing overcoat adhesion and corrosion resistance comparable or superior to those of the conventional chromated PCM steel panel.

SUMMARY OF THE INVENTION

The present invention has for its object to provide a nonchromate metallic surface treating agent for PCM use which is suited for metal-coated steel panels, particularly galvanized steel panels and is capable of imparting high processability and corrosion resistance to PCM steel panels, with the additional advantage of improved storage stability.

The nonchromate metallic surface treating agent for PCM use according to the present invention comprises, in each liter thereof, (a) a silane coupling agent and/or a hydrolytic condensation product thereof in an amount of 0.01 to 100 g/l, (b) water-dispersible silica in an amount of 0.05 to 100 g/l (solids), and (c) a zirconium compound in an amount of 0.01 to 50 g/l in terms of zirconium ion and/or a titanium compound in an amount of 0.01 to 50 g/l in terms of titanium ion.

The nonchromate metallic surface treating agent for PCM use according to the present invention may contain one or more members selected from among sulfide ion, thiosulfate ion, persulfate ion and a triazinethiol compound in an amount of 0.01 to 100 g/l.

The method of treating a metallic surface according to the present invention comprises treating the surface of a metal-coated steel panel with any of the above metallic surface treating agents, and is most suited for the surface treatment of zinc-coated steel panels.

The method of producing a PCM steel panel according to the present invention comprises treating the surface of a metal-coated steel panel with any of said metallic surface treating agents and applying a chromium-free primer and a top coating serially thereon.

The PCM steel panel of the present invention is obtainable by the above production method.

DETAILED DESCRIPTION OF THE INVENTION

As the silane compound as one of its essential components, the metallic surface treating agent of the present invention contains a silane coupling agent and/or a hydrolytic condensation product thereof. The hydrolytic condensation product of a silane coupling agent means an oligomer obtainable by hydrolytic polymerization of the silane coupling agent.

The silane coupling agent which can be used as above in the present invention is not particularly restricted but includes the following, among others: vinylmethoxysilane, vinyltrimethoxysilane, vinylethoxysilane, vinyltriethoxysilane, 3-aminopropyltriethoxysilane, 3-glycidoxypropyltrimethoxysilane, 3-methacryloxypropyltrimethoxysilane, 3-mercaptopropyltrimethoxysilane, N-(1,3-dimethylbutylidene)-3-(triethoxysilyl)-1-propanamine, N,N'-bis[3-(trimethoxysilyl)propyl]ethylenediamine, N-(β-aminoethyl)-γ-aminopropylmethyldimethoxysilane, N-(β-aminoethyl)-γ-aminopropyltrimethoxysilane, γ-aminopropyltrimethoxysilane, γ-aminopropyltriethoxysilane, γ-glycidoxypropyltrimethoxysilane, γ-glycidoxypropyltriethoxysilane, γ-glycidoxypropylmethyldimethoxysilane, 2-(3,4-epoxycyclohexyl)ethyl-trimethoxysilane, γ-methacryloxypropyltrimethoxysilane, γ-methacryloxypropyltriethoxysilane, γ-mercaptopropyltrimethoxysilane, γ-mercaptopropyltriethoxysilane and N-[2-(vinylbenzylamino)ethyl]-3-aminopropyltrimethoxysilane.

The particularly preferred silane coupling agent includes vinylmethoxysilane, vinylethoxysilane, 3-aminopropyltriethoxysilane, 3-glycidoxypropyltrimethoxysilane, 3-methacryloxypropyltrimethoxysilane, 3-mercaptopropyltrimethoxysilane, N-(1,3-dimethylbutylidene)-3-(triethoxysilyl)-1-propanamine and N,N'-bis[3-(trimethoxysilyl)propyl]ethylenediamine. These silane coupling agents can be used each alone or in a suitable combination.

In the present invention, said silane compound is caused to be present in a concentration of 0.01 to 100 g/l, preferably 0.5 to 25 g/l, in [each liter of] the metallic surface treating agent. If the concentration of the silane coupling compound is less than 0.01 g/l, the corrosion resistance- and adhesion-enhancing effect of the nonchromate rust-preventive coating agent will be deficient. If the use of the silane coupling compound exceeds 100 g/l, the corrosion resistance-enhancing effect will not be improved any further and rather an economic disadvantage will result.

As the silane compound as one of its essential components, the metallic surface treating agent of the present invention contains water-dispersible silica. The water-dispersible silica which can be used in the present invention is not particularly restricted but is preferably spherical silica, chain like silica or aluminum-modified silica, which is lean in sodium and other impurities and weakly basic. The spherical silica includes colloidal silicas such as "Snowtex N" and "Snowtex UP" (both manufactured by Nissan Chemical) and fumed silica such as "Aerosil" (Japan Aerosil); the chainlike silica includes silica gel such as "Snowtex PS" (Nissan Chemical); and the aluminum-modified silica includes "Adelite AT-20A" (Asahi Denka), all of which are commercially available.

The water-dispersible silica is caused to be present in an amount of 0.05 to 100 g/l, preferably 0.5 to 60 g/l, on a solid basis, in each liter of the metallic surface treating agent. If the proportion of water-dispersible silica is less than 0.05 g/l, the corrosion resistance-enhancing effect will be insufficient, while the use of silica in excess of 100 g/l will not be rewarded with any further improvement in corrosion resistance but rather detract from the bath stability of the metallic surface treating agent.

The metallic surface treating agent of the present invention further contains a zirconium compound and/or a titanium compound. The zirconium compound includes ammonium zirconyl carbonate, zirconium hydrofluoride, ammonium zirconium fluoride, potassium zirconium fluoride, sodium zirconium fluoride, zirconium acetylacetonate, zirconium butoxide-1-butanol solution, zirconium n-propoxide and so on. The titanium compound includes titanium hydrofluoride, ammonium titanium fluoride, potassium titanium oxalate, titanium isopropoxide, isopropyl titanate, titanium ethoxide, titanium 2-ethyl-1-hexanolate, tetraisopropyl titanate, tetra-n-butyl titanate, potassium titanium fluoride, sodium titanium fluoride, and so on. These compounds may be used each alone or in a suitable combination.

The above-mentioned zirconium compound and/or titanium compound is caused to be present, in each liter of the metallic surface treating agent of the invention, in a concentration of 0.01 to 50 g/l, preferably 0.05 to 5 g/l, in terms of zirconium ion or titanium ion. If the concentration of the above compound falls less than 0.01 g/l, corrosion resistance will become insufficient. If it exceeds 50 g/l, no improvement will be realized in overcoat adhesion and, in addition, the bath stability will be rather sacrificed.

The metallic surface treating agent of the present invention may further contains at least one sulfur-containing compound selected from the group consisting of a sulfide, a thiosulfuric acid compound, a persulfuric acid compound, and these compounds contribute to corrosion resistance.

The sulfide mentioned above includes sodium sulfide, ammonium sulfide, manganese sulfide, molybdenum sulfide, iron sulfide and vanadium sulfide, among others.

The thiosulfate includes ammonium thiosulfate, sodium thiosulfate and potassium thiosulfate, among others.

The persulfate includes ammonium persulfate, sodium persulfate and potassium persulfate, among others.

The triazinethiol compound includes 2,4,6-trimercapto-S-triazine, 2-butylamino-4,6-dimercapto-S-triazine, 2,4,6-trimercapto-S-triazine monosodium salt, 2,4,6-trimercapto-S-triazine trisodium salt, 2-anilino-4,6-dimercapto-S-triazine, and 2-anilino-4,6-dimercapto-S-triazine monosodium salt, among others.

These compounds can be used each alone or in a suitable combination.

The concentration of the above sulfur-containing compound(s) in the metallic surface treating agent, per liter of the composition, is 0.01 to 100 g/l, preferably 0.1 to 10 g/l, in terms of a total amount of sulfide ion, thiosulfate ion, persulfate ion and/or triazine compound. If the concentration of said ion(s) is less than 0.01 g/l, the expected corrosion resistance-enhancing effect will not be expressed. On the other hand, if the upper limit of 100 g/l is exceeded, the corrosion resistance-enhancing effect will not be improved any further and rather an economic disadvantage will result.

The metallic surface treating agent of the present invention may further contain other components. As such other components, there can be mentioned tannic acid inclusive of its salt, phytic acid inclusive of its salt, and water-base resin. The water-base resin which can be used includes acrylic resin, urethane resin, epoxy resin, ethylene-acrylic copolymer, phenolic resin, polyester resin and polyacrylic resin, among others. When a water-base resin is used, an organic solvent may be used concomitantly for improving its film-forming properties to thereby provide a more uniform, smooth film.

The metallic surface treating agent of the present invention can be used as a surface treating agent for metal-coated steel panels such as zinc-coated, aluminum-coated, tin-coated and other coated steel panels. The method of using this surface treating composition, that it to say the method of treating a metallic surface, may comprise applying said metallic surface treating agent to a substrate metallic surface and drying the coat or comprise heating such a substrate in advance, applying the metallic surface treating agent of the invention and allowing the coat to dry by utilizing the residual heat of the substrate.

In both cases, the above drying procedure can be carried out at room temperature to 250° C. for 2 seconds to 5 minutes. If the limit of 250° C. is exceeded, adhesion and corrosion resistance will be adversely affected. The preferred conditions are 40 to 180° C. and 5 seconds to 2 minutes.

In the method of treating a metallic surface according to the present invention, the amount of deposition of said metallic surface treating agent of the invention is preferably not less than 0.1 $mg/m^2$as a dry coat thickness. If the amount of deposition is less than 0.1 $mg/M^2$, the rust-preventive effect will be insufficient. On the other hand, if the amount of deposition is excessive, it will be uneconomical as an under coat for PCM coating and, in addition, cumbersome procedure-wise. Therefore, the more preferred amount of deposition is 0.5 to 500 $mg/m^2$, particularly 1 to 250 $mg/m^2$.

In the method of treating a metallic surface according to the present invention, the mode of use of said metallic surface treating agent is not particularly restricted. Thus, the routine techniques such as roller coating, shower coating, spray coating, dipping and brush coating can be selectively employed. The optimum steel substrate includes metal-coated steel panels, particularly zinc-coated steel panels, for PCM use.

The method of producing PCM steel panels according to the present invention comprises treating a metal-coated steel panel with said metallic surface treating agent, drying the coat, applying a nonchromate primer, drying the primer coat, and finally applying a top coating.

Said nonchromate primer may be any primer not containing a chromate type rust-preventive pigment in its formation. Preferred primer is a primer containing a vanadate type rust-preventive pigment and a phosphate type rust-preventive pigment (V/P pigment primer).

The coating amount of said primer is preferably equivalent to a dry coat thickness of 1 to 20 μm. If the dry coat thickness is less than 1 μm, corrosion resistance will be insufficient. If the thickness exceeds 20 μm, overcoat adhesion will not be as good as desired. The curing conditions for said nonchromate primer may be 150 to 250° C., in terms of metal surface temperature, and a curing time of 10 seconds to 5 minutes.

The top coating mentioned above is not particularly restricted but may be any of the conventional top coating s for PCM use.

The coating technology for said nonchromate primer and said top coating is not particularly restricted but includes roller coating, shower coating, air-spray coating, airless-spray coating and dip coating, among others.

The nonchromate metallic surface treating agent for PCM use according to the invention contains a silane coupling agent and/or a hydrolytic condensation product thereof, water-dispersible silica, and a zirconium compound and/or a titanium compound. This metallic surface treating agent is suited to metals, particularly zinc-coated steel panels, is capable of imparting excellent processability and corrosion resistance to PCM steel panels without enlisting the help of chromium, and exhibits a sufficiently long shelf-life.

Furthermore, by applying the metallic surface treating agent of the invention to a process for producing nonchromated PCM steel panels, steel panels can be provided with processability and corrosion resistance equivalent or even superior to those of the conventional PCM steel panels obtainable by using a chromate-containing rust-preventing agent.

The above advantages seem to come forth from the fact that as the metallic surface treating agent of the present invention contains a silane coupling agent, the reactive moiety of the silane coupling agent is firmly bound to the substrate metal surface through metasiloxane bonding and the organic moiety of the hydrophobic group is firmly bound to the organic nonchromate primer film coated thereon to improve adhesion and thereby contribute to increased corrosion resistance. Moreover, particles of the water-dispersible silica are adsorbed and oriented on the substrate surface to act as a barrier against corrosive ions and moisture and thereby suppress corrosion, while the silanol group present on the silica surface enhances the adhesion between the organic primer coat formed thereon and the metal surface. As to the zirconium ion, the formation of a zirconium oxide coat on the metal surface enhances corrosion resistance and, at the same time, the zirconium acts as a crosslinking agent for the primer applied thereon to increase the crosslinking density of the organic film to thereby further contribute to corrosion resistance, adhesion and coin scratch resistance. In addition, the sulfur-containing compound passivates the metal surface, thus contributing to corrosion resistance.

The PCM steel panel obtained in accordance with the present invention has excellent processability and corrosion resistance and, as such, finds application in a broad field of uses, such as household electrical appliances, computer-related devices, architectural members, and automotive and other industrial products.

EXAMPLES

The following examples are intended to describe the present invention in further detail and should by no means be construed as defining the scope of the invention.

Example 1

To 1 L of pure water was added 1.5 g of Sila-Ace S-330 (γ-aminopropyltriethoxysilane; Chisso Corporation), and the mixture was stirred at room temperature for 5 minutes. Then, 0.5 g of Snowtex N (water-dispersible silica; Nissan Chemical) was further added and the mixture was stirred for 5 minutes. In addition, 0.02 g, in terms of Zr ion, of Zircosol AC-7 (zirconyl ammonium carbonate; Daiichi Rare Elements Co.) was added, followed by stirring for 5 minutes to give a nonchromate metallic surface treating agent for PCM use. This metallic surface treating agent was degreased with an alkaline cleaner (Surf Cleaner 155; Nippon Paint) and, using a #3 bar coater, applied onto a dried commercial zinc hot-dip galvanized steel plate (Nippon Test Panel Co.; 70×150×0.4 mm) in a dry film thickness equivalent to 20 mg/m$^2$. After drying at a metal surface temperature of 60° C., a V/P pigment-containing nonchromate primer was applied in a dry film thickness of 5 μm using a #16 bar coater and dried at a metal surface temperature of 215° C. Further, using a #36 bar coater, Flexicoat 1060 (a polyester top coating paint; Nippon Paint) was applied in a dry film thickness of 15 μm as a top coating and dried at a metal surface temperature of 230° C. to prepare a testpiece. The bending adhesion, corrosion resistance, coin scratch resistance of the testpiece and the bath stability of the metallic surface treating agent were evaluated by the methods described hereinafter and the results were tabulated as shown in Table 1.

Examples 2 to 6 and Comparative Examples 1 and 2

Except that the silane coupling agent, water-dispersible silica and zirconium compound were varied in kind and concentration as shown in Table 1, the procedure of Example 1 was otherwise followed to prepare metallic surface treating agents. Using these metallic surface treating agents, testpieces were prepared in the same manner as in Example 1. These testpieces and the metallic surface treating agents (baths) were evaluated by the same methods as above. The results are shown in Table 1.

Comparative Example 3

Except that a commercial chromating agent for coating use (resin-containing type), in lieu of the metallic surface treating agent of the invention, was applied at a chromium deposition rate of 20 mg/m$^2$ and dried and that a chromate-containing primer (a primer containing a strontium chromate pigment) was used, the procedure of Example 1 was otherwise followed to prepare a testpiece and evaluate it. The results are shown in Table 1.

TABLE 1

| | | Coupling agent | | Silica | | Zr compound | | | Bending adhesion | | Corrosion resistance | | Coin scratch | Bath |
|---|---|---|---|---|---|---|---|---|---|---|---|---|---|---|
| | No. | Kind | g/L | Kind | g/L | Kind | g/L | Primer | Primary | Secondary | Cut zone | End face | resistance | stability |
| Example | 1 | 1 | 1.5 | 1 | 0.5 | 1 | 0.02 | Non-chromate | 5 | 5 | 5 | 5 | 4 | ○ |
| | 2 | 2 | 2.5 | 1 | 1 | 1 | 0.5 | Non-chromate | 5 | 5 | 5 | 5 | 5 | ○ |
| | 3 | 2 | 10 | 1 | 0.07 | 1 | 4 | Non-chromate | 5 | 5 | 5 | 4 | 5 | ○ |
| | 4 | 2 | 0.02 | 1 | 90 | 2 | 1 | Non-chromate | 5 | 5 | 5 | 5 | 5 | ○ |
| | 5 | 1 | 90 | 1 | 3 | 2 | 0.1 | Non-chromate | 5 | 5 | 5 | 5 | 5 | ○ |
| | 6 | 3 | 5 | 2 | 0.5 | 3 | 10 | Non-chromate | 5 | 5 | 5 | 5 | 5 | ○ |
| Compar. Ex. | 1 | 2 | 200 | 1 | 200 | 2 | 100 | Non-chromate | 1 | 1 | 4 | 3 | 2 | X |
| | 2 | 1 | 0.005 | 1 | 0.03 | 2 | 0.005 | Non-chromate | 2 | 1 | 2 | 2 | 1 | ○ |
| | 3 | Chromating agent for coating use | | | | | | Chromate | 2 | 5 | 4 | 3 | 4 | — |

Examples 7 to 12

The silane coupling agent, water-dispersible silica, zirconium compound and sulfur-containing compound were varied in kind and concentration as shown in Table 2, the procedure of Example 1 was otherwise repeated to prepare metallic surface treating agents. Using these metallic surface treating agents, testpieces were prepared in the same manner as in Example 1. Except that the salt spray time for corrosion resistance evaluation was changed to 500 hours, these testpieces were evaluated as in Example 1. The results are shown in Table 2.

2: Sila Ace S-510 (γ-glycidoxypropyltrimethoxysilane; Chisso Corporation)
3: Sila Ace S-810 (γ-mercaptopropyltrimethoxysilane; Chisso Corporation)

Water-dispersible Silica

1: Snowtex N (Nissan Chemical)
2: Snowtex O (Nissan Chemical)

Zirconium Compound

1: Zircosol AC-7 (ammonium zirconyl carbonate (Daiichi Rare Elements)

TABLE 2

| | | Coupling agent | | Silica | | Zr compound | | S compound | | | Bending adhesion | | Corrosion resistance | | Coin scratch | |
|---|---|---|---|---|---|---|---|---|---|---|---|---|---|---|---|---|
| | No. | Kind | g/L | Kind | g/L | Kind | g/L | Kind | g/L | Primer | Primary | Secondary | Cut zone | Edge | resistance | Bath Stability |
| Example | 7 | 1 | 2.5 | 1 | 25 | 2 | 0.5 | 1 | 0.02 | Non-chromate | 5 | 5 | 5 | 5 | 5 | ○ |
| | 8 | 2 | 25 | 1 | 5 | 1 | 5 | 2 | 75 | Non-chromate | 5 | 5 | 5 | 5 | 5 | ○ |
| | 9 | 1 | 50 | 1 | 0.1 | 2 | 0.1 | 4 | 1 | Non-chromate | 5 | 5 | 5 | 5 | 5 | ○ |
| | 10 | 2 | 5 | 1 | 1 | 1 | 0.2 | 3 | 5 | Non-chromate | 5 | 5 | 5 | 5 | 5 | ○ |
| | 11 | 1 | 1.5 | 2 | 0.5 | 4 | 5 | 3 | 2.5 | Non-chromate | 5 | 5 | 5 | 5 | 5 | ○ |
| | 12 | 2 | 2.5 | 1 | 1.5 | 5 | 0.5 | 3 | 1.5 | Non-chromate | 5 | 5 | 5 | 5 | 5 | ○ |
| | 13 | 2 | 1.5 | 1 | 2.5 | 1 + 5 | 0.5 + 0.5 | 3 | 5 | Non-chromate | 5 | 5 | 5 | 5 | 5 | ○ |

As the silane coupling agent, water-dispersible silica, zirconium compound, titanium compound and sulfur-containing compound (S compound) indicated above in Tables 1 and 2, the following commercial products were used.

Silane Coupling Agent

1: Sila Ace S-330 (γ-aminopropyltriethoxysilane; Chisso Corporation)

2: Ammonium zirconium fluoride (reagent)
3: Zirconium hydrofluoride (reagent)

Titanium Compound

1: Titanium hydrofluoride (reagent)
2: Ammonium titanium fluoride (reagent)

Sulfur Compound

1: Ammonium sulfide (reagent)
2: Ammonium persulfate (reagent)

3: Ammonium thiosulfate (reagent)
4: Triazinethiol (Santhiol N-1; Sankyo Kasei Co.)

Method of Evaluation

In the above Examples 1 to 13 and Comparative Examples 1 to 3, bending adhesion, corrosion resistance, coin scratch resistance and bath stability were evaluated in accordance with the following methods and criteria.

Bending Adhesion

Primary Adhesion

The testpiece was bent by 1800 (OTT) without interposition of a spacer in an environment controlled at 20° C. and the bent part was peeled 3 times using an adhesive tape. The degree of peeling was examined under a ×20 magnifying glass and rated on the following scale.

Score 5 points: no cracks
4 points: cracks all over the bend
3 points: the peeled area is less than 20% of the bend
2 points: the peeled area is not less than 20% and less than 80% of the bend
1 point: the peeled area is over 80% of the bend Secondary Adhesion The testpiece was immersed in boiling water for 2 hours and, then, allowed to sit under indoor conditions for 24 hours. The testpiece thus treated was bent in the same manner and rated on the same scale as in the primary adhesion test.

Corrosion Resistance

Cut Zone

The testpiece was cross-cut and subjected to the same salt spray test according to JIS Z 2317 for 360 hours (Examples 1 to 6; Comparative Examples 1 to 3) or 500 hours (Examples 7 to 13). The width of the blister formed on one side of the cutting line was measured and rated on the following scale.

Score 5 points: blister width=0 mm
4 points: blister width <1 mm
3 points: blister width ≧1 mm but <3 mm
2 points: blister width ≧3 mm but <5 mm
1 point: blister width >5 mm Edge The testpiece was subjected to a salt spray test as directed in JIS Z 2317 for 360 hours and the width of the blister formed along the upper burr edge was rated on the same scale as used for the cut zone.

Coin Scratch Resistance

The testpiece was scratched under a load of 1 kg using a coin scratch tester and the injured part was evaluated on the following rating scale.

Score 5 points: exposed primer area <10%; base metal not exposed
4 points: exposed primer area ≧10% but <70%; base metal not exposed
3 points: exposed primer area ≧70%; exposed base metal area <30%
2 points: exposed primer area ≧70%; exposed base metal area ≧30% but <70%
1 point: exposed primer area ≧70%; exposed base metal area ≧70%

Bath Stability

The metallic surface treating agent was stored in an incubator at 40° C. for 30 days and the degree of gelation and precipitation was evaluated on the following rating scale.

○: Neither gelation nor precipitation found
X: Gelation or precipitation found

It can be seen from Tables 1 and2 that the metallic surface treating agent of the present invention has a good shelf-life and that the nonchromate PCM steel panel produced by the method of the invention shows overcoat adhesion and corrosion resistance equivalent or superior to those of the chromated PCM steel panel.

What is claimed is:

1. A non-chromate metallic surface treating agent for precoated metal which comprises, in each liter thereof, (a) a silane coupling agent and/or a hydrolytic condensation product thereof in an amount of 0.01 to 100 g/l, (b) water-dispersible silica in an amount of 0.05 to 100 g/l (solids), and (c) a zirconium compound in an amount of 0.01 to 50 g/l in terms of zirconium ion and/or a titanium compound in an amount of 0.01 to 50 g/l in terms of titanium ion.

2. The non-chromate metallic surface treating agent for precoated metal according to claim 1 containing one or more members selected from the group consisting of sulfide ion, thiosulfate ion, persulfate ion and a triazinethiol compound, in an amount of 0.01 to 100 g/l.

3. A method of treating a metallic surface which comprises treating a metal-coated steel panel with the metallic surface treating agent according to claim 1.

4. The method of treating a metallic surface according to claim 3 wherein the metal-coated steel panel is a zinc-coated steel panel.

5. A method of producing a precoated metal steel panel which comprises treating a surface of a metal-coated steel panel with the metallic surface treating agent according to claim 1 and applying a chromium-free primer and a top coating serially thereon.

6. A precoated metal steel panel which is obtained by the method according to claim 5.

7. A method of treating a metallic surface which comprises treating a metal-coated steel panel with the metallic surface treating agent according to claim 2.

8. The method of treating a metallic surface according to claim 7 wherein the metal-coated steel panel is a zinc-coated steel panel.

9. A method of producing a precoated metal steel panel which comprises treating a surface of a metal-coated steel panel with the metallic surface treating agent according to claim 2 and applying a chromium-free primer and a top coating serially thereon.

10. A precoated metal steel panel which is obtained by the method according to claim 9.

* * * * *